US005706993A

United States Patent [19]

DeMatteis

[11] Patent Number: 5,706,993

[45] Date of Patent: Jan. 13, 1998

[54] ROLL BAG DISPENSING SYSTEM

[76] Inventor: Robert B. DeMatteis, 1668 Mill Stream Dr., Chino Hills, Calif. 91709

[21] Appl. No.: 680,212

[22] Filed: Jul. 11, 1996

Related U.S. Application Data

[63] Continuation-in-part of Ser. No. 297,135, Aug. 29, 1994, abandoned.

[51] Int. Cl.[6] ..... B26F 3/02

[52] U.S. Cl. ..... 225/106; 225/91

[58] Field of Search ..... 225/53, 66, 80, 225/81, 88, 91, 106

[56] References Cited

U.S. PATENT DOCUMENTS

| | | | |
|---|---|---|---|
| 757,844 | 4/1904 | Scott | 225/88 X |
| 767,233 | 8/1904 | McCourt et al. | 225/88 X |
| 1,122,673 | 12/1914 | Winter et al. | 225/46 X |
| 2,888,180 | 5/1959 | Kinker, Jr. | 225/91 X |
| 3,425,606 | 2/1969 | Burke | 225/91 X |
| 3,510,034 | 5/1970 | Caskey et al | 225/91 X |
| 3,542,268 | 11/1970 | Schramm | 225/91 X |
| 3,986,479 | 10/1976 | Bonk | 225/106 X |
| 4,711,384 | 12/1987 | Harris | 225/91 X |
| 5,048,738 | 9/1991 | Cardamone | 225/91 X |
| 5,135,146 | 8/1992 | Simhaee | 225/91 X |
| 5,219,424 | 6/1993 | Simhaee | 225/80 X |
| 5,480,084 | 1/1996 | Daniels | 225/106 X |
| 5,573,168 | 11/1996 | Kannankeril et al. | 225/106 |

FOREIGN PATENT DOCUMENTS

| | | | |
|---|---|---|---|
| 647.015 | 5/1964 | France | 225/91 |

*Primary Examiner*—Rinaldi I. Rada
*Assistant Examiner*—Elizabeth Stanley
*Attorney, Agent, or Firm*—Befhler & Pavitt

[57] ABSTRACT

A dispenser for a roll of bags joined in series end-to end along transverse severable lines comprising a receptacle in which a roll of bags may be held and rotated to pass the bags through the outlet of the receptacle and a web guide secured to the outlet. The web guide may be provided with a floor and inwardly overhanging side edges with the floor terminating in an upwardly projecting serrated edge which effects separation of each bag from its next ensuing bag.

2 Claims, 3 Drawing Sheets

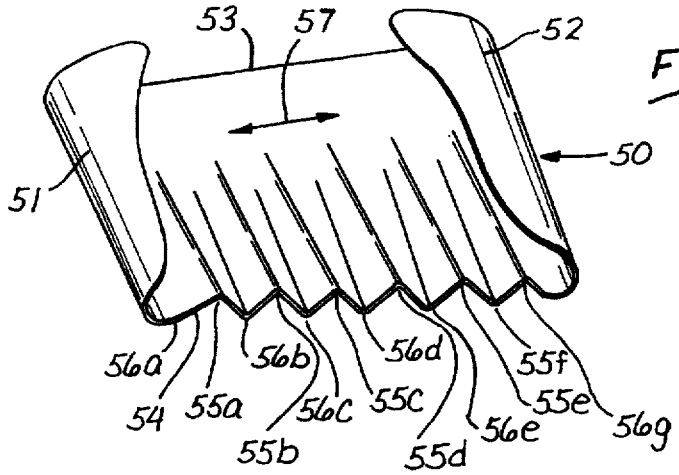
Fig. 8
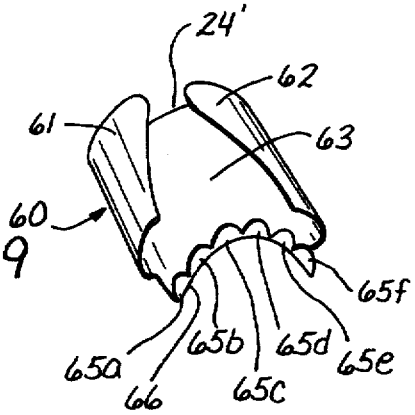
Fig. 9
Fig. 10
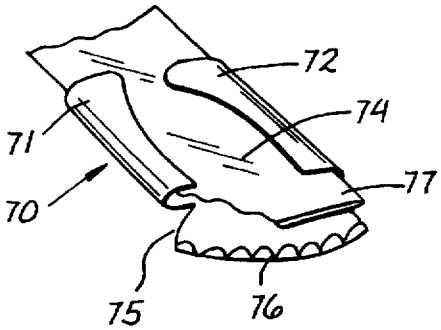
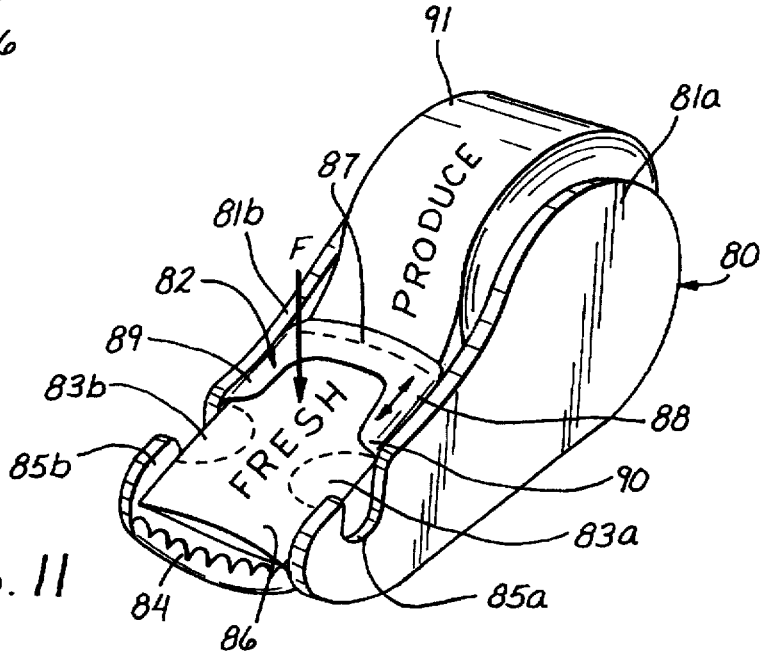
Fig. 11

ROLL BAG DISPENSING SYSTEM

This is a continuation-in-part application of application Ser. No. 08/297,135 filed Aug. 29, 1994 which is abandoned.

FIELD OF THE INVENTION

This invention relates to plastic bags on rolls and their dispenser-holders. For ease of explanation, reference is made only to the type of bags on rolls commonly referred to as star-seal bags and their holders, both of which are commonly used in many produce departments in supermarkets. These plastic star-seal bags are usually made from polyethylene plastic and are used by supermarket customers to pack their bulk produce, then carry it from the supermarket to home. The bags are subsequently used by the customer to protect the freshness of the bulk produce when stored inside their home refrigerator.

Star-seal bags on rolls mounted in their holders are compact and save space in the produce department. This is important as it lessens the interference with the display of produce. Star-seal bags also have stronger bottom seals which allow them to be made in thinner gauges, reducing raw material costs.

For these space-saving, cost-cutting, star-seal bags to be an effective replacement for old-fashioned roll produce bags, they must be dispensed in a system that is convenient and easy to use or which use is easy to understand. The dispenser holders must effectively singulate a bag upon dispensing so that the bags on the rolls do not drape down into the produce interfering with the display.

DESCRIPTION OF PRIOR ART

The present day star-seal bags used in produce departments are put up on a roll. The core of this roll is typically a 1" plastic tube which is commonly about 4" long. It extends out past the roll bag web ½" on both sides. Thus, the web on a roll of star-seal bags is typically 3" wide. When opened, the bag expands to 12" wide overall. The length of a bag is typically about 18". A full roll will have about 500–750 bags, depending upon gauge and bag length, with a roll diameter of about 7.5". Another common size is a 4.75" core with a 3.75" bag web, in which the bag opening expands to 15" wide. The bags of the most common prior art variety are connected via a special perforation line which has a 1⅜" slot in the middle of the perforation line where the bags are unconnected. This style of bags on a roll is illustrated in U.S. Pat. No. 5,219,424.

A roll of prior art bags is mounted into a holder whereas the ½" extensions on both sides of the plastic core slip down into guides maintaining the roll in position for dispensing forward. This is illustrated in a continuation in part of U.S. Pat. No. 5,135,146, referred to as Docket No. 2669/16347US1. Or, as illustrated in U.S. Pat. No. 5,135,146 the roll of bags may be mounted upon an axle. The first bag on the roll is pulled forward over a tongue which snags the 1⅜" wide slot in the middle. Pulling further forward causes the first bag to tear at the perforation lines on both sides of the unconnected slot and be separated from the roll. The next bag on the roll now rests just behind the tongue, retained in a gap. This gap is the space between the tongue and a finger, which is located upstream of said tongue. The next bag in the roll, retained in the gap, is now ready for it to be pulled forward, up over the tongue, separated and dispensed in the same manner as before.

The dispensing operation of the prior art bag as referenced above requires some mechanical know-how or some trial and error before it is learned. It requires the narrow 3" wide web to be aligned atop the tongue and the bag to be pulled generally straight forward and down. If the bag is pulled to the side it will slide off the tongue, failing to snag at the slot in the perforation, and separation from the roll will fail. Or, a bag may be pulled to the side and snag the knob, but the perforations on only one side of the center unconnected break will tear free. In either case singulation of the forward-most bag on the roll fails and the several, forward-most bags on the roll will then droop down into the produce. The user must then separate the forward-most bag from the roll by tearing at the perforations using his two hands.

Furthermore, the manufacture of prior art bags requires close tolerances on the perforation line with its 1⅜" slot. The special perforation die required to make a perforation line with the slot must be lined up exactly in the middle for best results. If the slot wanders from one side or the other, it can cause inconsistent singulation of the bags upon dispensing, or total failure to singulate if the slot misses the tongue on the dispenser altogether.

SUMMARY OF THE INVENTION

The bags and system of the present invention include bags on a roll, a unique dispenser-holder, and a unique web guide, which together improve dispensing and ease of use. This is accomplished by using a traditional style of perforation without slots as required in the prior art variety bag disclosed in U.S. Pat. No. 5,219,424. The perforation die to make the perforation line can be any of a number of generally standard perforation die configurations. The roll of bags mount into a basket style holder and feed through a web guide at the base of the basket. From the base of the basket extends a floor which terminates at a smooth serrated edge. This smooth serrated edge is typically of a saw tooth pattern in which the teeth are steep enough to engage the perforation connecting the bags on the roll, but yet the teeth are smooth enough to not tear the thin plastic film.

Bags on a roll are dispensed by a user pulling the forward-most bag forward, through the web guide and across the floor to the smooth serrated terminal edge. When the perforation at the end of the forward-most bag reaches the smooth teeth of the serration at the terminal edge, the smooth teeth engage the perforation and the bag is singulated as it separates from the roll. The next bag in series on the roll now rests conveniently atop the floor, ready for its dispensing.

The system of the present invention is easy to understand, easy to use and requires very little trial and error if any. As the web guide literally guides the roll bag over the floor to the smooth serrated terminal edge, the user instinctively, naturally, knows how to singulate a bag upon dispensing from the roll.

BRIEF DESCRIPTION OF THE DRAWINGS

FIG. 8 illustrates a variation of the floor.

FIG. 9 illustrates another variation of the floor.

FIG. 10 illustrates a floor with its smooth serrated terminal edge and a bend allowing for easier grasping of the bag about to be dispensed.

FIG. 11 illustrates a dispenser for the bags with its accompanying floor and finger guide.

DETAILED DESCRIPTION OF THE DRAWINGS

Figure 1:
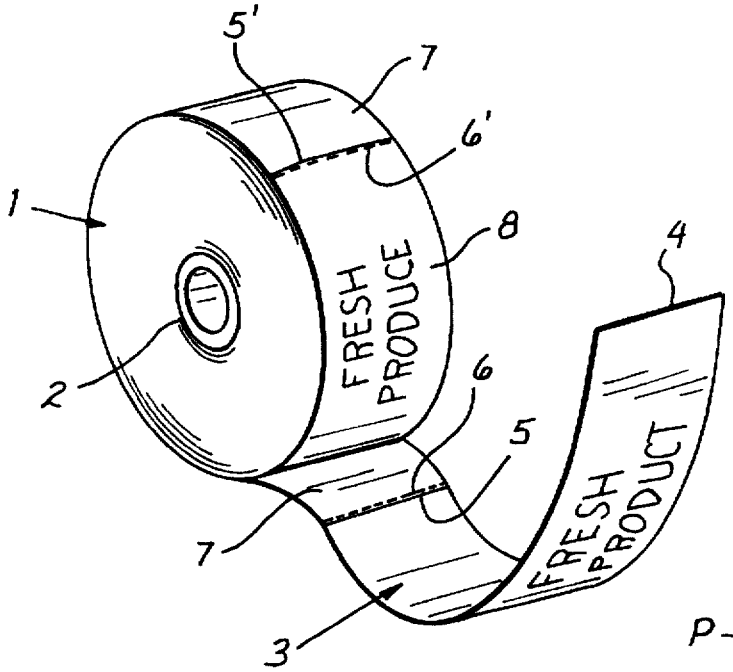
FIG. 1 illustrates the roll of star-seal bags of the present invention.

In FIG. 1, a roll 1 of star-seal bags is wound upon core 2. First and forward-most bag 3 has an open mouth 4 and bottom seal 5. It is connected to roll 1 at perforation line 6. Perforation line 6 also defines the mouth of second bag 7 in roll 1. As illustrated, second bag 7 is wound around roll 1, has its bottom seal 5' and is connected at its perforation line 6' to the third bag 8 in roll 1.

Figure 2:
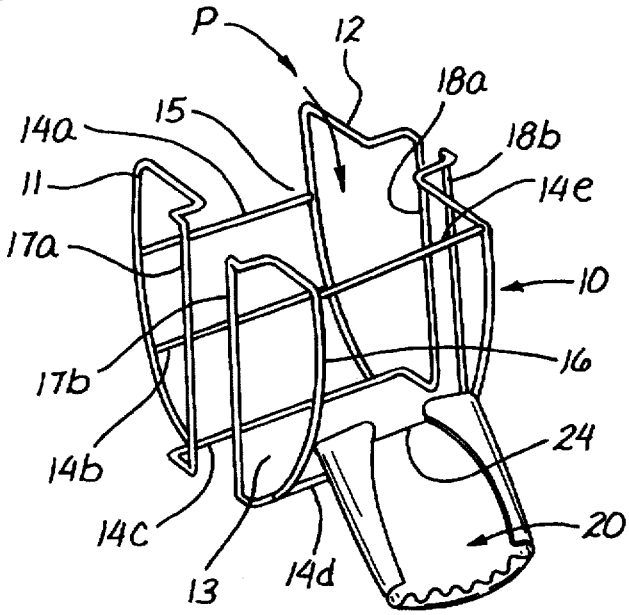
FIG. 2 illustrates the dispenser for the roll of bags in FIG. 1.

In FIG. 2 universal wire frame dispenser 10 is shown with left side 11, right side 12, bottom area 13 and open top area 15. Sides 11 and 12 are structurally connected by cross supports 14*a*, 14*b*, 14*c*, 14*d* and 14*e*. Between sides 11 and 12 and bottom 13, spaced by supports 14*a*, 14*b*, 14*c*, 14*d* and 14*e* is created a basket area 16. It is in basket area 16 in which a roll 1 of bags of the present invention can be placed as illustrated by arrows P. At the middle region of left side 11 the wire frame is bent outwards at two adjoining 90 degree angles to form vertical structures 17*a* and 17*b*. Additionally, complementary vertical structures 18*a* and 18*b* are formed on right side 12. Both vertical structures 17*a* and 17*b*, 18*a* and 18*b*, define a 1" wide vertical guide for accepting 1" plastic roll cores if so desired. At the front side of dispenser 10 at the bottom area 13, extends a web guide, which comprises floor 20 as further illustrated in the blow-up FIG. 3.

Figure 3:
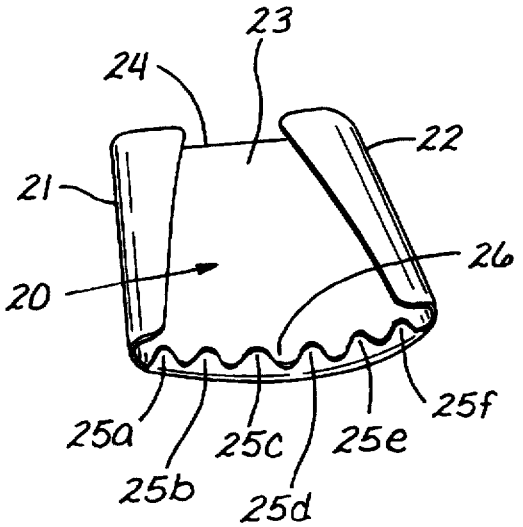
FIG. 3 illustrates a blow-up of the projecting floor.

At the sides of floor 20 of blow-up FIG. 3 are rolled up left side 21 and a rolled up right side 22 which together form a web guide. Rolled up sides 21 and 22 serve to guide the bag web as will be later illustrated. Floor 20 has a flat surface 23 between rolled up sides 21 and 22. At the back side of floor 20, at location 24, is where floor 20 is connected to holder 10. It is also at location 24 where the forward-most bag of the present invention, resting in dispenser 10, will be inserted and pulled forward readied for dispensing. At the front edge of floor 20 is the smooth serrated terminal edge 26 comprised of six smooth serrated teeth 25*a*, 25*b*, 25*c*, 25*d*, 25*e* and 25*f*, which smooth serrated teeth point generally upwards and are shown in the preferred embodiment in a slightly forwardly arched position. That is, each smooth tooth more centrally located is situated in the arch a bit further forward than its outboard companion. In this manner, the outermost smooth teeth 25*a* and 25*f* are the furthest back in the arch, with more centrally located smooth teeth 25*b* and 25*e* slightly more forward and central-most smooth teeth 25*c* and 25*d* the furthest forward in the arch. This arched serrated, terminal edge 26 is further illustrated in FIG. 4.

Figure 4:
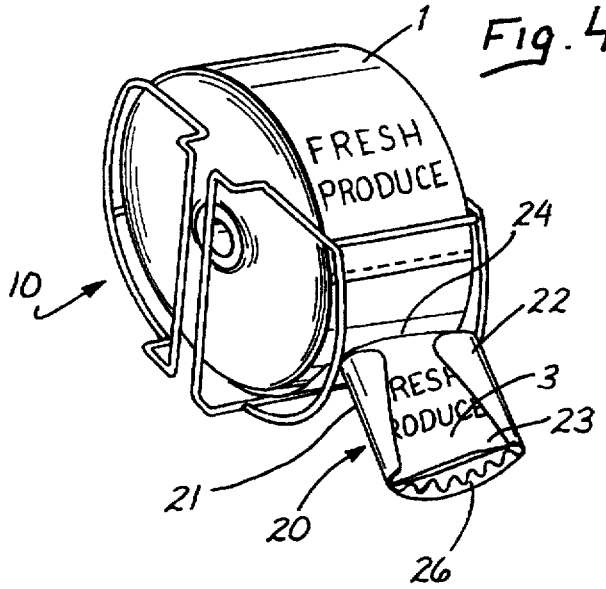
FIG. 4 illustrates the roll of bags in FIG. 1 as it sits in the dispenser of FIG. 2, with the first bag ready for dispensing.

FIG. 4 shows a roll 1 of star-seal bags, of the present invention, mounted in dispenser 10. Forward-most bag 3 has been inserted at the back location 24 of floor 20, sits atop surface 23, between rolled up web guide sides 21 and 22, and is ready for dispensing. The arch of the serrated edge 26 of floor 20 is clearly illustrated.

Figure 5:
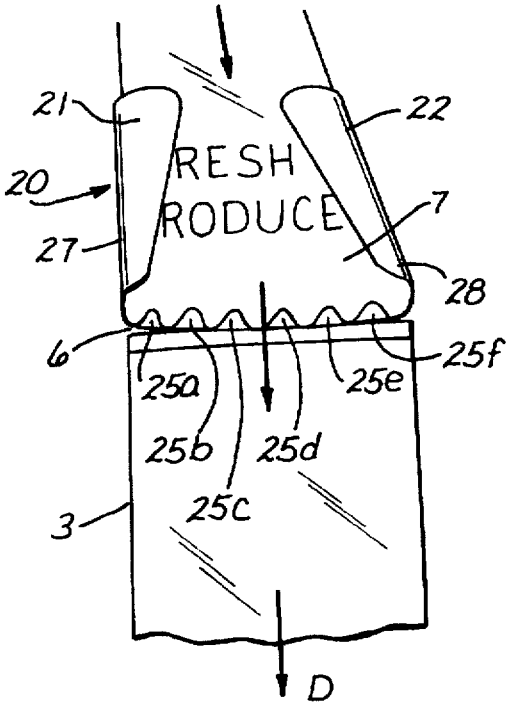
FIG. 5 is a blow-up of the bag separation process on the projecting floor illustrated in FIG. 3.

In the blow-up FIG. 5, forward-most bag 3 has been pulled forward in the direction D illustrated by three arrows. As bag 3 is pulled forward in floor 20, the web is guided between rolled up web guide sides 21 and 22. Perforation line 6 of bag 3 is seen snagged on smooth teeth 25*a*, 25*b*, 25*c*, 25*d*, 25*e* and 25*f*. It can be seen that at the two outer smooth teeth locations 25*a* and 25*f*, perforation line 6 has already begun to tear and separate. As bag 3 continues being pulled in its forward direction D, the perforation 6 will then continue its tearing from the outermost connection points to the innermost connection points. This is caused by the arched smooth serrated terminal edge 26 of floor 20 as more clearly illustrated in FIG. 3 and FIG. 4. As bag 3 continues in its forward path, it separates in its entirety completing the singulation process. The next bag in the roll, bag 7, now rests in the convenient dispensing disposition as illustrated in FIG. 5. It is the natural friction of bag 7 between rolled up web guide sides 21 and 22 of floor 20, and in particular at frontal locations 27 and 28 where the rolled up sides 21 and 22 are narrowed, which maintains the bag atop the floor 20. The smooth serrated terminal edge 26 also improves the ability for a user to naturally dispense and singulate bags when pulled partially sideways, or pulled from a side.

Figure 6:
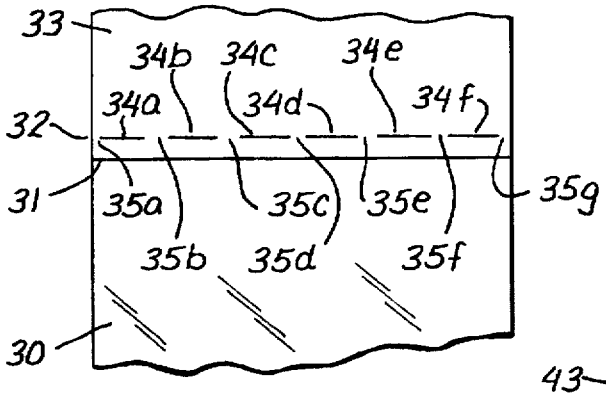
FIG. 6 is the preferred embodiment of a standard perforation used in the system of the present invention.

The bag web of FIG. 6 is illustrated on a 1:1 scale, which for this example we will assume the web measures 3 1/16". Bag 30 has a bottom seal 31 in which proximate to it is perforation line 32 connecting bag 30 to bag 33. Perforation line 32 is comprised of six cut lines 34*a*, 34*b*, 34*c*, 34*d*, 34*e* and 34*f*; each of the cut lines spaced by seven tit connections 35*a*, 35*b*, 35*c*, 35*d*, 35*e*, 35*f* and 35*g*. The six cut lines, 34*a* through 34*f*, all measure about 7/16" in width whereas all tit connections, 35*a* through 35*g*, measure about 1/16" in width. The total of the measurements equal the 3 1/16" web width. The reader should understand that the width of floor 20 illustrated throughout will be approximately equal, or slightly wider than, the web width of the roll. And the width of the smooth teeth 25*a* through 25*f* of floor 20 will be approximately equal the width of the perforation slits 34*a* through 34*f*.

Figure 7:
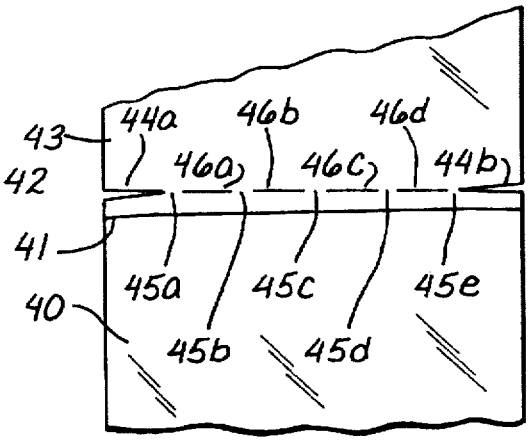
FIG. 7 illustrates a variation of the perforation style of the present invention.

In another variation of a bag web, FIG. 7 shows bag 40 with bottom seal 41, in which proximate to it is perforation line 42 connecting bag 41 to bag 43. Perforation line 42 differs in that at the outside edge of the web, the perforation is not connected but instead begins with a cut section 44*a* and 44*b*. In this example, there are only four perforation lines 46*a*, 46*b*, 46*c* and 46*d*, plus 5 tit connections at 45*a*, 45*b*, 45*c*, 45*d* and 45*e*. The two outer cut sections 44*a* and 44*b* facilitate separation at the perforation line during the dispensing process.

In FIG. 8 one variation of a web guide, which comprises of a floor 50 has a left rolled up side 51 and a right rolled up side 52, back edge 53 and front terminal edge 54. Front terminal edge 54 shows a series of upwardly pointed smooth ridges 55*a*, 55*b*, 55*c*, 55*d*, 55*e* and 55*f*; in between the ridges at front edge 54 are valleys 56*a*, 56*b*, 56*c*, 56*d*, 56*e*, 56*f* and 56*g*. About two-thirds rearwardly of floor 50 in region 57, all the ridges 55*a*, 55*b*, 55*c*, 55*d*, 55*e* and 55*f* have flattened to meet or be substantially level with all the valleys, 56*a*, 56*b*, 56*c*, 56*d*, 56*e*, 56*f* and 56*g*. It is at the front terminal edge 54, where the smooth ridges 55*a* through 55*f* cause separation at the bag perforation in substantially the same manner as in floor 20 with its smooth teeth 25*a* through 25*f*.

FIG. 9 illustrates a third variation of the web guide, which, in this embodiment, comprises a rounded floor 60 with rolled up left side 61 and rolled up right side 62. Floor 60 has a rounded surface 63 between rolled up sides 61 and 62. At the back side of floor 60, at location 24''' (24 prime), is where floor 60 is connected to its holder. At the front edge of floor 60 is a smooth serrated terminal edge 66 comprised of six smooth serrated teeth 65*a*, 65*b*, 65*c*, 65*d*, 65*e* and 65*f*, which smooth serrated teeth point generally upwards and outwards. It too may have the centrally located teeth positioned in a slightly forward arch.

In FIG. 10 a fourth variation of the web guide comprises a floor 70 which is similar to floor 20. It has rolled up sides 71 and 72, a flat surface 73 between the rolled up sides, and a front smooth serrated terminal edge 76. However, in floor 70 the smooth serrated terminal edge 76 is projected further outwards and further downwards. This is done by bending the metal material of floor 70 at location 75 to approximate a 20 degree angle. The cut-away illustration of bag 74 shows bend 75 and shows how the front edge 77 of bag 74 projects outward, elevated above smooth serrated terminal edge 76, and making it easy for the user to grasp.

The dispenser 80 in FIG. 11, which is another embodiment of the wire frame holder or receptacle 10 in FIG. 2, is made with plastic or painted sheet metal sides 81*a* and 81*b*, and has all the fundamental attributes for function as does the holder in FIG. 2 and FIG. 4. Dispenser holder 80 also shows a fifth variation of the web guide which comprises floor 82. However it has three preferred embodiments improving its dispensing ability. The first preferred embodiment is illustrated about one-third the way up floor 82 where there are two circular finger cut-outs 83*a* and 83*b* indicated by dotted lines which are cut out of the base section 84 of floor 82. Circular finger cut-outs 85*a* and 85*b* located respectively on sides 81*a* and 81*b* are exactly matched alongside circular finger cut-outs, 83*a* and 83*b*, respectively. At the location of the matched circular finger cut-outs, 83*a* and 85*a*, plus 83*b* and 85*b*, a user inserts a finger, grasps bag 86, and pulls forward much in the same manner as dispensing scotch tape from its dispenser. Singulation occurs as previously detailed in FIG. 5. It is a second preferred embodiment that the upper rear portion 87 of floor 82 is one solid piece spanning atop the floor and connecting rolled up sides 89 and 90. This second preferred embodiment allows roll of bags 91 to feed forward regardless of whether roll of bags 91 unwinds from its top or bottom. It is a third preferred embodiment that upper rear location 87 and lower rear location 88, indicated by dotted lines, of floor 82 are slightly arched upward at the center. This arching serves two purposes. First, it provides a positive structural advantage improving strength against a downward force (F). Second, it causes the web of bag 86 to also be arched improving the bag web's structure as it spans cut-outs 83*a* and 83*b*.

OTHER ATTRIBUTES AND APPLICATIONS

As previously stated, the use of the present invention is not limited to systems used in produce departments in grocery stores. The present invention has applications in other areas of the supermarket as well as other industrial and commercial uses. For instance, it can be mounted on portable trash liner bins and other types of receptacles for easy dispensing of bags or liners.

Furthermore, the holder is not limited to use with only star-seal bags. The reader can see it can be an effective dispenser for other types of roll bags as well. Roll bags and their perforations may be of virtually any size and dimension.

What is claimed:

1. In combination, a roll of plastic bags joined in series end-to-end along transverse perforated lines between adjacent bags, each bag having a leading edge, and a trailing edge attached to the leading edge of the next ensuing bag of the roll; and a dispenser for said roll, said dispenser comprising:

a receptacle configured to receive and hold the bag roll, said receptacle having an outlet, said receptacle permitting the bag roll to be unwound with each bag in the roll as the bag is unwound from the roll passing through the receptacle outlet;

a web guide, said guide extending from the outlet of the receptacle and defining a path extending from the outlet in a first predetermined direction, said web guide comprising a floor, said floor commencing at the receptacle outlet and extending in said first predetermined direction to a terminal edge projecting transversely across the path defined by the web guide, said floor having rising side edges, said terminal edge of said floor being serrated with a plurality of smooth peaks to form a smooth serrated terminal edge to engage each perforated line between adjacent bags, and the terminal edge of the floor being curved convexedly in said first predetermined direction thereby to initiate severance of the bag being pulled from the ensuing bag along the transverse perforated line between said bag being pulled and the next ensuing bag, at the outer ends of said line, and continuing to the center of the line;

whereby, as each bag of the bag roll is unwound from the roll and pulled through the receptacle outlet, it is drawn through the web guide and confined to the floor by the side edges of the guide floor until its trailing edge of the bag reaches the smooth serrated terminal edge of the floor, whereupon, when the bag being pulled is separated from the next ensuing bag along the perforated line between the trailing edge of the bag being pulled and the leading edge of the next ensuing bag by the engagement of the said perforated line with the smooth serrated terminal edge of the floor, the thus detached bag being pulled may be withdrawn for filling or other use, and the next ensuing bag is laid on the web guide floor readied for dispensing.

2. The combination as described in claim 1 wherein the receptacle outlet and web guide are unitary.

* * * * *